US005630365A

United States Patent [19]

Hertelendi

[11] Patent Number: 5,630,365

[45] Date of Patent: May 20, 1997

[54] RAIL LOADING TRAIN FOR TRANSPORTING AS WELL AS LOADING AND UNLOADING LONG RAILS

[75] Inventor: Josef Hertelendi, Freilassing, Germany

[73] Assignee: Georg Robel GmbH & Co., München, Germany

[21] Appl. No.: 446,504

[22] Filed: May 22, 1995

[30] Foreign Application Priority Data

May 26, 1994 [DE] Germany ..... 44 18 376.3

[51] Int. Cl.[6] ..... B60P 3/04

[52] U.S. Cl. ..... 104/5

[58] Field of Search ..... 105/396, 370–373, 105/375, 378, 379, 404, 408; 104/2, 5; 414/339, 461

[56] References Cited

U.S. PATENT DOCUMENTS

| | | | |
|---|---|---|---|
| 1,566,570 | 12/1925 | App | 104/5 |
| 4,281,870 | 8/1981 | Ehrlich | 105/372 |
| 4,498,418 | 2/1985 | Chumley | 105/372 |

FOREIGN PATENT DOCUMENTS

| | | | |
|---|---|---|---|
| 1208326 | 1/1966 | Germany | 104/5 |
| 2734748 | 2/1979 | Germany | 104/5 |
| 589672 | 3/1959 | Italy | 104/5 |

*Primary Examiner*—Robert J. Oberleitner
*Assistant Examiner*—C. T. Bartz
*Attorney, Agent, or Firm*—Henry M. Feiereisen

[57] ABSTRACT

A rail loading train for transporting as well as loading and unloading long rails, includes a number of loading cars coupled together and having a frame which has a longitudinal axis and is supported on undercarriages for movement in an operating direction. Mounted on the loading cars are a plurality of rail supports which are spaced from each other longitudinally in direction of the frame and respectively rotatably mounted on support columns. Each rail support includes a separate pivot drive for swinging the rail support about a vertical axis between a receiving position in which the rail support extends perpendicular to the longitudinal axis and an idle position in which the rail support extends in direction of the longitudinal axis, whereby the position of the rail support in each end position is automatically secured by a locking mechanism once the swinging motion is concluded.

38 Claims, 2 Drawing Sheets

Fig. 2
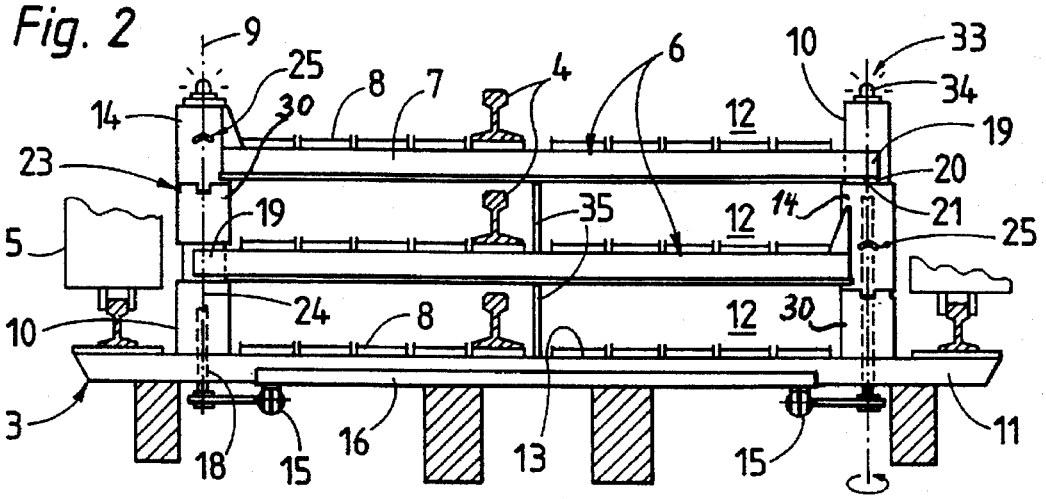
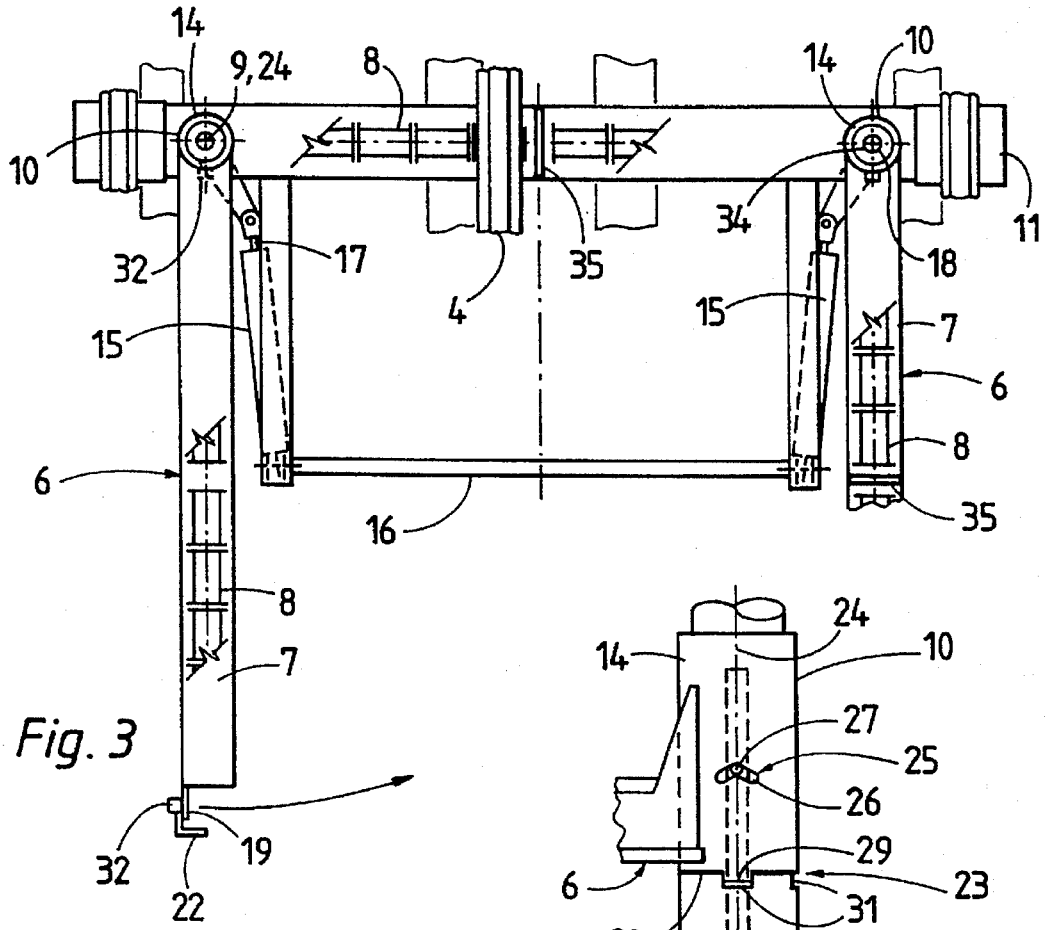
Fig. 3
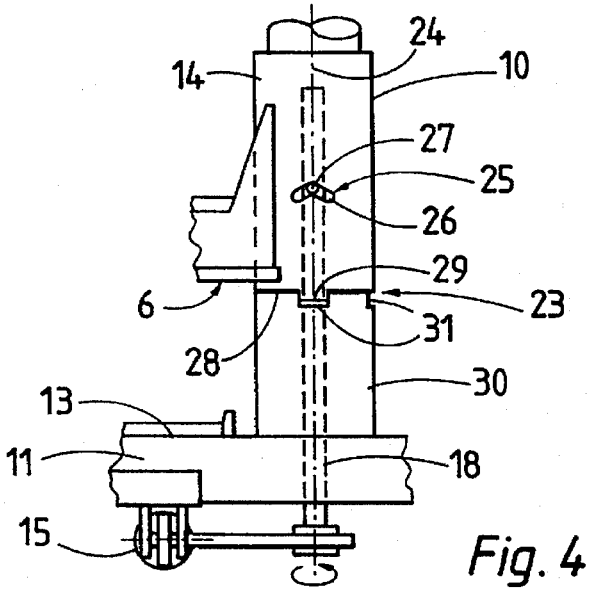
Fig. 4

RAIL LOADING TRAIN FOR TRANSPORTING AS WELL AS LOADING AND UNLOADING LONG RAILS

BACKGROUND OF THE INVENTION

The present invention refers to a rail loading train for transporting as well as loading and unloading long rails, and in particular to a rail loading train of a type having a plurality of loading cars supported on undercarriages for movement in an operating direction of a track and including rail supports spaced from each other longitudinally in direction of the track and swingably mounted for rotation about a vertical axis between a receiving position in which the rail supports extend across the car and an idle position in which the rail supports extend in longitudinal direction of the car, with the desired end position being secured by a locking mechanism.

German Pat. No. DE 12 08 326 B discloses a rail loading train of this type, including a plurality of cars linked together for supporting long rails during transport, with each car being provided with rail supports mounted to the car frame at a distance to each other in longitudinal direction of the car for allowing support of rails at various levels overlying each other. Each rail support on each level includes two horizontal load-bearing beams, each of which being swingably mounted on one end onto a support column for rotation about a vertical axis, with both vertical support columns being positioned opposite to each other in the lateral flank area of the loading car. In the idle position, the load-bearing beams extend parallel in opposite direction to each other along the car flank in order to permit access to rails supported on the level underneath. In the receiving position, the load-bearing beams, each of which forming one half of the rail support, are pivoted inwards toward each other by 90° and joined together in the center of the car.

German Pat. No. DE 27 34 748 B discloses a similar rail loading train in which the horizontal swinging of the rail supports between both end positions and the locking of the long rails in the respective end position are carried out manually by an operator. Thus, the operator has to walk the entire length of the train. Taking into consideration the increasingly greater length of such loading trains for hauling long rails and the rising number of required rail supports to carry these long rails, a manual manipulation of the rail supports becomes very time-consuming and cumbersome and results in unproductive waiting periods.

SUMMARY OF THE INVENTION

It is an object of the present invention to provide an improved rail loading train, obviating the aforestated drawbacks.

In particular, it is an object of the present invention to provide an improved rail loading train which can be operated in a highly efficient manner while significantly reducing any waiting periods.

These objects and others which will become apparent hereinafter are attained in accordance with the present invention by providing each rail support with a separate pivot drive, and by incorporating a locking mechanism by which the rail support is automatically secured in a desired position after concluding a swinging motion.

In accordance with the present invention, the operation of the rail supports to move between the receiving position and the idle position can now be remote-controlled by the operator at significant simplification to attain a high degree of productivity. Moreover, as the locking mechanism automatically secures the rail supports in the receiving and idle positions, the simplicity of the overall operation is complemented by a highest degree of safety during loading and unloading as well as transport of the rails. The work can thus not only be significantly accelerated to thereby shorten the waiting periods to an absolute minimum but the safety of the working personnel is enhanced as there is no need for the operator to walk the entire length of trains of e.g. 300 m length, and to manipulate heavy devices so that any sources of danger are eliminated.

Preferably, the pivot drive of each rail support is formed as a hydraulic drive positioned underneath the loading deck of the car and linked to a bearing sleeve via a pivot bar and a slotted-link mechanism. The bearing sleeve is rotatably mounted onto a support column and carries one end of the rail support. The pivot bar is rotatably set within the bearing sleeve and is formed with a radially projecting bolt which engages a slotted guideway of the bearing sleeve. The guideway is of inverted V-shaped configuration so that a rotation of the pivot bar lifts in an initial phase the bearing sleeve and the rail support from one end position upwardly until a locking lug projecting from the lower edge of the bearing sleeve disengages from a subjacent support ring. At disengagement from the support ring, the bearing sleeve follows the rotation of the pivot bar so as to swing the rail support into the other end position. After concluding this swinging motion, the weight of the rail support forces the locking lug to automatically engage the support ring to secure the position of the rail support.

The cantilevered, free end of the rail support, distant to the bearing sleeve, is suitably provided with a stop member which is engageable in the one support column which is positioned opposite to the bearing sleeve and provided for propping a rail support on a different level. In order to indicate to the operator when the rail supports are set in an end position, each rail support is equipped with a limit stop switch which triggers an optical and/or acoustical signaling system, e.g. in form of a lamp. Thus, when the rail supports occupy the desired position and are securely locked, the lamps illuminate to signal to the operator the termination of the operation. The provision of such a signaling system further optimizes the safety aspect while requiring only minimal equipment.

BRIEF DESCRIPTION OF THE DRAWING

The above and other objects, features and advantages of the present invention will now be described in more detail with reference to the accompanying drawing in which:

FIG. 2 is an illustration of the loading train in direction of arrow II in FIG. 1, showing the rail supports in receiving position;

FIG. 3 is a plan view of the rail support of the loading train, showing the rail supports in idle position;

FIG. 4 is a fragmentary, enlarged side view of a locking mechanism of the rail support;

DETAILED DESCRIPTION OF PREFERRED EMBODIMENTS

Figure 1:
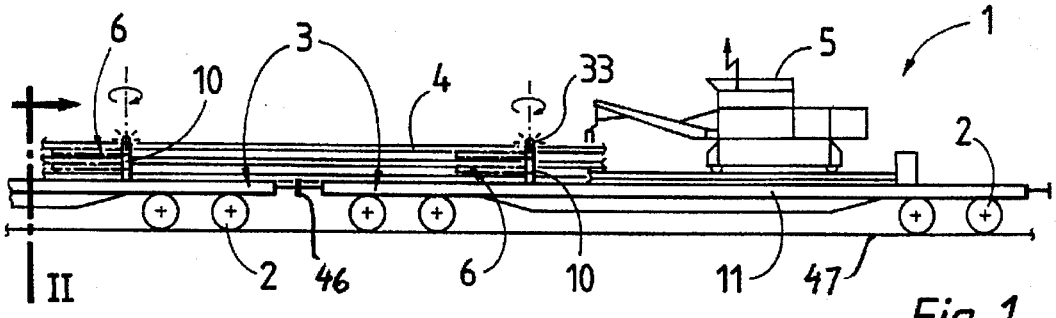
FIG. 1 is a schematic, fragmentary side elevational view of one embodiment of a rail loading train according to the present invention for transport of long rails.

Throughout all the Figures, the same or corresponding elements are generally indicated by the same reference numerals.

Turning now to the drawing, and in particular to FIG. 1, there is shown a fragmentary side elevational view of one embodiment of a rail loading train according to the present invention, generally designated by reference numeral 1. The rail loading train 1 is comprised of a plurality of sequentially arranged loading cars 3 which are suitably linked to each other by couplings, schematically indicated at 46. Each loading car 3 has an elongated car frame 11 which is supported on undercarriages 2 for movement in an operating direction along track 47. In the non-limiting example of FIG. 1, the rail loading train 1 is used for hauling long rails 4, e.g. continuous welded rails (CWR), which are loaded and unloaded by means of a gantry crane 5 movably supported on the train 1.

The long rails 4 are placed by the gantry crane 5 upon a plurality of rail supports which are generally designated by reference numeral 6 and mounted at a suitable distance from each other in longitudinal direction of the car 3 to the frame 11 via respective support columns 10. As will be described in more detail with reference to FIGS. 2 and 3, each rail support 6 is movable between an idle position in which the rail support 6 extends longitudinally in direction of the car 3, and a receiving position in which the rail support 6 extends transversely across the car 3 for supporting a rail 4. For illustrative purposes, FIG. 1 shows the idle position of the rail supports 6 in broken line.

Turning now to FIG. 2, there is shown a detailed illustration of the loading car in direction of arrow II of FIG. 1. Each rail support 6 includes a horizontal load-bearing beam 7 which carries rollers 8 on its upper surface to allow a shift of long rails 4 in longitudinal direction. The load-bearing beam 7 of each rail support 6 is connected on one end to a bearing sleeve 14 which is rotatably mounted on a support ring 30 of the respective support column 10 for rotation about a vertical axis 9 which coincides with the longitudinal axis 24 of the support column 10. The support columns 10 oppose each other in transverse direction of the car 3 and are positioned along the longitudinal sides of the frame 11.

FIG. 2 shows the receiving position of the rail supports 6 which are thus swiveled inwardly for holding rails 4, while FIG. 3 shows the idle position in which the rail supports 6 are outwardly swung to extend longitudinally in direction of the car frame 11.

As shown in the non-limiting example of FIG. 2, opposing support columns 10 carry each one rail support 6 so that two rail supports 6 are arranged above each other at a vertical distance to define two levels 12 for receiving a row of long rails 4. Thus, in a same vertical plane, the rail supports 6 are mounted alternately to the pertaining bearing sleeves 14, i.e. one rail support 6 is attached to a bearing sleeve 14 on the left side of the car frame 11 and the other rail support 6 is attached to a bearing sleeve 14 on the right side of the car frame 11. A third base level 12 is formed by the loading deck 13 of the car frame 11, with the loading deck 13 also being equipped with rollers 8 to allow a shifting of long rails in longitudinal direction. In order to underprop the beams 7 of the rail support 6 when fully loaded with long rails 4, posts 35 are positioned between the levels 12 at a central location.

Each rail support 6 is equipped with a separate pivot drive 15 for effecting the swiveling motion between the idle position and the receiving position. The pivot drive 15 is provided in form of a hydraulic drive which is secured underneath the loading deck 13 to a mounting 16 which is attached to the frame 11. As shown in particular in FIG. 3, the pivot drive 15 has a connecting rod 17 which reciprocates in a cylinder and is articulated to a pivot bar 18 which extends vertically coaxial to the longitudinal axis 24 within the support column 10 and is rotatably supported for rotation about the longitudinal axis 24. With its upper end, the pivot bar 18 is connected to the bearing sleeve 14 via a coulisse-type linkage or slotted-link mechanism, generally designated by reference numeral 25, as will be described further-below.

The cantilevered, free end of each rail support 6, distant to the bearing sleeve 14, is formed with a stop member 19 which, in the receiving position of the rail support 6, bears upon the one support column 10 in opposite relationship to the bearing sleeve 14. Suitably, each support column 10 is provided with an engagement groove 20 for receiving a lower edge 21 of the stop member 19. A further stop member 22 is mounted to the car frame 11 for limiting the swiveling motion of the rail support 6 from the receiving position into the idle position.

In order to secure the rail supports 6 in the idle and receiving positions, a locking mechanism, generally designated by reference numeral 23, is provided by which the rail support 6 is automatically secured after concluding a swinging motion. As shown in detail in FIG. 4, which is a fragmentary illustration of the support column 10 on the right hand side in FIG. 2, the slotted-link mechanism 25 is comprised of a slotted guideway 26 formed in the bearing sleeve 14 and a slider in form of a bolt 27 received in the guideway 26 and secured to the pivot bar 18, with the guideway 26 being shaped in form of an inverted flat V. The bearing sleeve 14 rests upon the support ring 30 and is provided with a locking lug 29 which projects integrally from the lower edge 28 of the bearing sleeve 14 for selective engagement in two recesses 31 spaced from each other by 90° relative to the longitudinal axis 24.

Upon activation of the pivot drive 15, the rotation of the pivot bar 18 causes the bolt 27 to move within the guideway 26 so that the bearing sleeve 14 together with the beam 7 of the rail support 6 are lifted from the support ring 30 of the column 10 and from the support post 35. A rotation of the bearing sleeve 14 is prevented as long as the locking lug 29 is engaged in the recess 31. Once the bolt 27 reaches the apex of the V-shaped guideway, the locking lug 29 is fully withdrawn from the recess 31, so that a rotation of the pivot bar 18 causes a swinging of the bearing sleeve 14 via the bolt 27 about the longitudinal axis 24. After reaching the other end position through a rotation by about 90° , the own weight of the rail support 6 forces the locking lug 29 to engage the other recess 31 of the support ring 30 to secure the rail support 6 in the end position.

Each rail support 6 is provided with a limit stop switch 32 for triggering an optical and/or acoustical signal when the beam 27 reaches either of the two end positions. The limit stop switch 32 is part of a signaling system, generally designated by reference numeral 33 and including lamps 34 respectively mounted to the upper end of the support columns 10. The illumination of the lamps 34 informs the operator seated in the gantry crane 5 about the conclusion of the swinging motion, as triggered by remote control, and the locking of the rail supports 6 in the respective end position.

Figure 5:
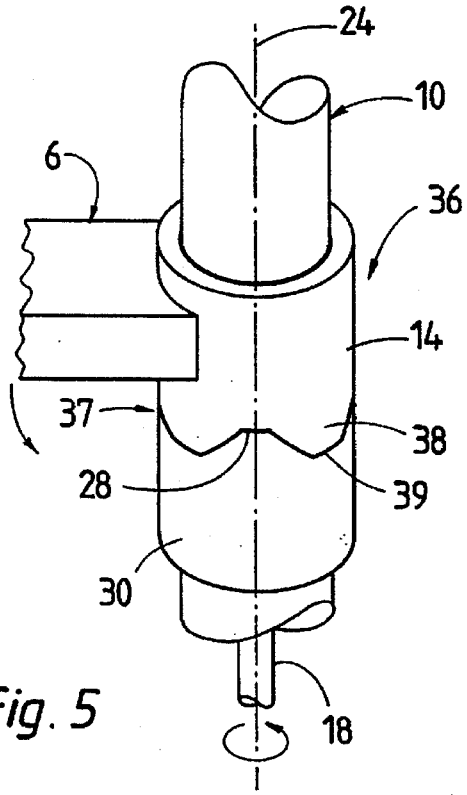
FIG. 5 is a fragmentary, perspective illustration of a modified locking mechanism of the rail support.

Turning now to FIG. 5, there is shown a fragmentary view of a modified locking mechanism, generally designated by reference numeral 36, in form of a tongue-and-groove joint or cam control 37. The lower edge 28 of the bearing sleeve 14 is provided with trapezoidal cams 38 for engagement with matching grooves 39 in the support ring 30. A total of four interlocking, complementary pairs of cams 38 and grooves 39 are provided and spaced by 90° about the circumference of the support column 10. After the pivot bar 18 rotates the rail support 6 via the bearing sleeve 14 to swing to the other end position, the own weight of the rail support 14 effects an engagement of the cams 38 in the grooves 39 to lock the rail support 6 in this position.

Persons skilled in the art will understand that the described locking mechanism 37 in form of a tongue-and-groove joint with cams 38 and grooves 39 between the support ring 30 and the bearing sleeve 14 may be substituted by a complementary undulation in form of a sinusoid curve of the interface between the support ring 30 and the bearing sleeve 14. Such configuration would reduce the friction between the bearing sleeve 14 and the support ring 30 during swinging motion.

Figure 6:
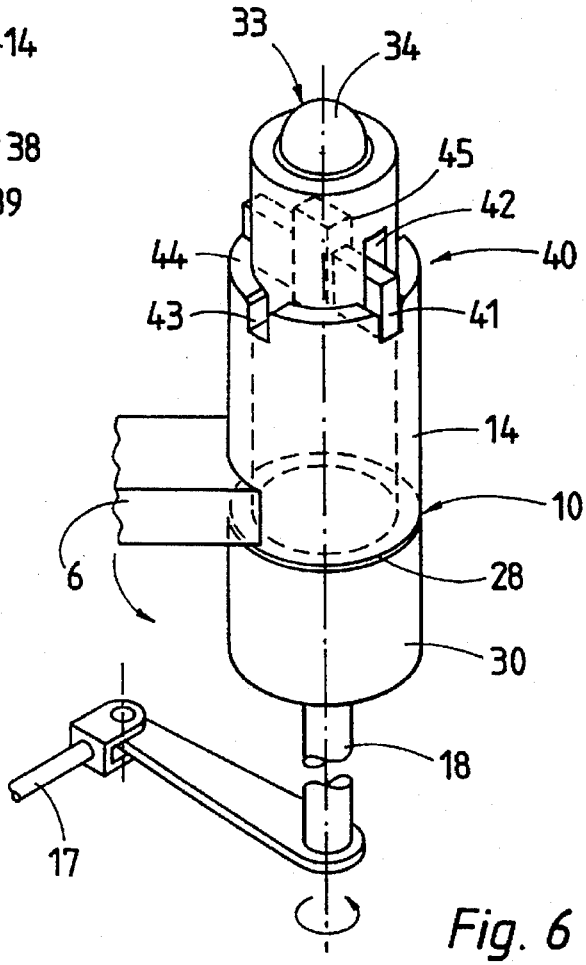
FIG. 6 is a fragmentary, perspective illustration of still another variation of a further locking mechanism of the rail support.

Turning now to FIG. 6, there is shown a further variation of a locking mechanism, generally designated by reference numeral 40, for securing the end positions of the rails supports 6. The locking mechanism 40 includes a locking bar 41 which is guided in a vertical slot 42 of the support column 10 and is engageable in engagement grooves 43 spaced from each other by 90° about the circumference of the upper rim 44 of the rotatable bearing sleeve 14. The lower rim 28 of the bearing sleeve 14 is even and smooth to glide upon the support ring 30. The disengagement of the locking mechanism 40 to allow the rail support 6 to swing from one end position to the other end position, is effected by a solenoid 45 by which the locking bar 41 is lifted and retracted from the respective grooves 43 so that the bearing sleeve 14 can be rotated by the pivot bar 18 when the pivot drive 15 is activated. After reaching the respective end position of the rail support 6, the force of gravity causes the locking bar 41 to engage into the grooves 43 again. Suitably, the solenoid 45 is linked to the signaling system 33 of limit stop switches 32 and lamps 34.

It will be appreciated by persons skilled in the art, that the present invention is certainly not limited to the provision of pairs of opposing support columns across the car frame. Instead, only a single support column may be arranged centrally on the car frame with respect to the transverse direction to carry the rail supports.

While the invention has been illustrated and described as embodied in a rail loading train for transporting as well as loading and unloading long rails, it is not intended to be limited to the details shown since various modifications and structural changes may be made without departing in any way from the spirit of the present invention.

What is claimed as new and desired to be protected by Letters Patent is set forth in the appended claims:

I claim:

1. A rail loading train for transporting as well as loading and unloading rails; comprising:

a loading car having a frame supported on undercarriages for movement in an operating direction;

support means mounted on said frame for supporting long rails, said support means including a plurality of rail supports spaced from each other longitudinally in direction of said frame, each said rail support including a separate pivot drive for swinging said rail support about a vertical axis between a receiving position in which said rail support extends perpendicular to said frame and an idle position in which said rail supports extends longitudinally in direction of the frame, and a locking mechanism including a slotted-link mechanism operatively connected to each of said rail supports for automatically securing said rail supports after said rail supports conclude a swinging motion and occupy the receiving and idle positions, wherein said support means includes a support column secured to said frame for attachment of a rail support and a support ring connected to said support column and having two recesses spaced from each other about the longitudinal axis by 90°, and a bearing sleeve resting on said support ring coaxial to the longitudinal axis of said support column and connected to said rail support, said slotted-link mechanism including a slotted guideway formed in said bearing sleeve, and a slider projecting from said pivot bar and received in said guideway, said locking mechanism further including a locking lug projecting from a lower edge of said bearing sleeve for selective engagement in said recesses of said support ring in the end positions of said rail support.

2. The rail loading train of claim 1 wherein said support means includes a support column secured to said frame for attachment of a rail support and having a longitudinal axis coinciding with said vertical axis, said pivot drive being provided in form of a hydraulic drive located underneath a loading deck of said loading car and having a connecting rod linked to a pivot bar set coaxial to and rotatable about the longitudinal axis of said support column.

3. The rail loading train of claim 2, further comprising a signaling system for indicating an end position of said rail supports, and a limit stop switch operatively connected to each rail support for actuation of said signaling system.

4. The rail loading train of claim 3 wherein said signaling system is an element selected from the group consisting of an optical signaling system and an acoustic signaling system.

5. The rail loading train of claim 3 wherein said signaling system is formed by a lamp assembly mounted to an upper end of said support column.

6. The rail loading train of claim 1 wherein said rail support has one end connected to said bearing sleeve and another free end distant to said bearing sleeve, and further comprising a stop member secured to the other end of said rail support for abutment upon a support column opposing said bearing sleeve.

7. The rail loading train of claim 6 wherein each said support column has a groove for engagement by a lower edge of said stop member.

8. A rail loading train for transporting as well as loading and unloading long rails; comprising:

a loading car having a frame supported on undercarriages for movement in an operating direction;

support means mounted on said frame for supporting long rails, said support means including a plurality of rail supports spaced from each other longitudinally in direction of said frame, each said rail support including a separate pivot drive for swinging said rail support about a vertical axis between a receiving position in which said rail support extends perpendicular to said frame and an idle position in which said rail supports extends longitudinally in direction of the frame, and a locking mechanism operatively connected to each of said rail supports for automatically securing said rail supports after said rail supports conclude a swinging motion and occupy the receiving and idle positions, wherein said support means includes pairs of support columns opposing each other across said loading car, with each support column of a pair of support columns being associated to a locking mechanism in form of a slotted-link mechanism, with one slotted-link mechanism being connected to a first rail support and the other slotted-link mechanism being connected to a second rail support arranged underneath said first rail support.

9. The rail loading train of claim 8 wherein said locking mechanism includes a slotted-link mechanism.

10. The rail loading train of claim 9 wherein said support means includes a support column secured to said frame for attachment of a rail support and a support ring connected to said support column and having two recesses space from each other about the longitudinal axis by 90°, and a bearing sleeve resting on said support ring coaxial to the longitudinal axis of said support column and connected to said rail support, said slotted-link mechanism including a slotted guideway formed in said bearing sleeve, and a slider projecting from said pivot bar and received in said guideway, said locking mechanism further including a locking lug projecting from a lower edge of said bearing sleeve for selective engagement in said recesses of said support ring in the end positions of said rail support.

11. The rail loading train of claim 10 wherein said rail support has one end connected to said bearing sleeve and another free end distant to said bearing sleeve, and further comprising a stop member secured to the other end of said rail support for abutment upon a support column opposing said bearing sleeve.

12. The rail loading train of claim 11 wherein each said support column has a groove for engagement by a lower edge of said stop member.

13. The rail loading train of claim 8 wherein said support means includes a support ring connected to said support column and a bearing sleeve resting on said support ring coaxial to the longitudinal axis of said support column and connected to said rail support, said locking mechanism being provided in form of a tongue-and-groove joint with cams projecting from a lower edge of said bearing sleeve for engagement in matching grooves of said support ring in the end positions of said rail support.

14. The rail loading train of claim 8 wherein said support means includes a support column secured to said frame for attachment of a rail support and having a longitudinal axis coinciding with said vertical axis, said pivot drive being provided in form of a hydraulic drive located underneath a loading deck of said loading car and having a connecting rod linked to a pivot bar set coaxial to and rotatable about the longitudinal axis of said support column.

15. The rail loading train of claim 14, further comprising a signaling system for indicating an end position of said rail supports, and a limit stop switch operatively connected to each rail support for actuation of said signaling system.

16. The rail loading train of claim 15 wherein said signaling system is an element selected from the group consisting of an optical signaling system and an acoustic signaling system.

17. The rail loading train of claim 15 wherein said signaling system is formed by a lamp assembly mounted to an upper end of said support column.

18. The rail loading train of claim 8 wherein said support means includes a support column secured to said frame and standing upright from said frame, and a bearing sleeve rotatably mounted to said support column and connected to said rail support, said bearing sleeve having one end provided with circumferential grooves, said locking mechanism including a locking bar received in said support column and a solenoid acting on said locking bar to selectively engage said grooves of said bearing sleeve in the end positions of said rail support.

19. A rail loading train for transporting as well as loading and unloading long rails; comprising:

a loading car having a frame supported on undercarriages for movement in an operating direction;

support means mounted on said frame for supporting long rails, said support means including a plurality of rail supports spaced from each other longitudinally in direction of said frame, each said rail support including a separate pivot drive for swinging said rail support about a vertical axis between a receiving position in which said rail support extends perpendicular to said frame and an idle position in which said rail supports extends longitudinally in direction of the frame, and a locking mechanism operatively connected to each of said rail supports for automatically securing said rail supports after said rail supports conclude a swinging motion and occupy the receiving and idle positions, wherein said support means includes a support column secured to said frame for attachment of a rail support, a support ring connected to said support column and a bearing sleeve resting on said support ring coaxial to the longitudinal axis of said support column and connected to said rail support, said locking mechanism being provided in form of a tongue-and-groove joint with cams projecting from a lower edge of said bearing sleeve for engagement in matching grooves of said support ring in the end positions of said rail support.

20. The rail loading train of claim 19 wherein said support means includes a support column secured to said frame and standing upright from said frame, and a bearing sleeve rotatably mounted to said support column and connected to said rail support, said bearing sleeve having one end provided with circumferential grooves, said locking mechanism including a locking bar received in said support column and a solenoid acting on said locking bar to selectively engage said grooves of said bearing sleeve in the end positions of said rail support.

21. The rail loading train of claim 19 wherein said support means includes a support column secured to said frame for attachment of a rail support and having a longitudinal axis coinciding with said vertical axis, said pivot drive being provided in form of a hydraulic drive located underneath a loading deck of said loading car and having a connecting rod linked to a pivot bar set coaxial to and rotatable about the longitudinal axis of said support column.

22. The rail loading train of claim 19 wherein said locking mechanism includes a slotted-link mechanism.

23. The rail loading train of claim 22 wherein said support means includes a support column secured to said frame for attachment of a rail support and a support ring connected to said support column and having two recesses spaced from each other about the longitudinal axis by 90°, and a bearing sleeve resting on said support ring coaxial to the longitudinal axis of said support column and connected to said rail support, said slotted-link mechanism including a slotted guideway formed in said bearing sleeve, and a slider projecting from said pivot bar and received in said guideway, said locking mechanism further including a locking lug projecting from a lower edge of said bearing sleeve for selective engagement in said recesses of said support ring in the end positions of said rail support.

24. The rail loading train of claim 23 wherein said rail support has one end connected to said bearing sleeve and another free end distant to said bearing sleeve, and further comprising a stop member secured to the other end of said rail support for abutment upon a support column opposing said bearing sleeve.

25. The rail loading train of claim 24 wherein each said support column has a groove for engagement by a lower edge of said stop member.

26. The rail loading train of claim 21, further comprising a signaling system for indicating an end position of said rail supports, and a limit stop switch operatively connected to each rail support for actuation of said signaling system.

27. The rail loading train of claim 26 wherein said signaling system is an element selected from the group consisting of an optical signaling system and an acoustic signaling system.

28. The rail loading train of claim 26 wherein said signaling system is formed by a lamp assembly mounted to an upper end of said support column.

29. A rail loading train for transporting as well as loading and unloading long rails; comprising:

a loading car having a frame supported on undercarriages for movement in an operating direction;

support means mounted on said frame for supporting long rails, said support means including a plurality of rail supports spaced from each other longitudinally in direction of said frame, each said rail support including a separate pivot drive for swinging said rail support about a vertical axis between a receiving position in which said rail support extends perpendicular to said frame and an idle position in which said rail supports extends longitudinally in direction of the frame, and a locking mechanism operatively connected to each of said rail supports for automatically securing said rail supports after said rail supports conclude a swinging motion and occupy the receiving and idle positions, wherein said support means includes a support column secured to said frame and standing upright from said frame, and a bearing sleeve rotatably mounted to said support column and connected to said rail support, said bearing sleeve having one end provided with circumferential grooves, said locking mechanism including a locking bar received in said support column and a solenoid acting on said locking bar to selectively engage said grooves of said bearing sleeve in the end positions of said rail support.

30. The rail loading train of claim 29 wherein said support means includes a support column secured to said frame for attachment of a rail support, a support ring connected to said support column and a bearing sleeve resting on said support ring coaxial to the longitudinal axis of said support column and connected to said rail support, said locking mechanism being provided in form of a tongue-and-groove joint with cams projecting from a lower edge of said bearing sleeve for engagement in matching grooves of said support ring in the end positions of said rail support.

31. The rail loading train of claim 29 wherein said support means includes a support column secured to said frame for attachment of a rail support and having a longitudinal axis coinciding with said vertical axis, said pivot drive being provided in form of a hydraulic drive located underneath a loading deck of said loading car and having a connecting rod linked to a pivot bar set coaxial to and rotatable about the longitudinal axis of said support column.

32. The rail loading train of claim 29 wherein said locking mechanism includes a slotted-link mechanism.

33. The rail loading train of claim 32 wherein said support means includes a support column secured to said frame for attachment of a rail support and a support ring connected to said support column and having two recesses spaced from each other about the longitudinal axis by 90°, and a bearing sleeve resting on said support ring coaxial to the longitudinal axis of said support column and connected to said rail support, said slotted-link mechanism including a slotted guideway formed in said bearing sleeve, and a slider projecting from said pivot bar and received in said guideway, said locking mechanism further including a locking lug projecting from a lower edge of said bearing sleeve for selective engagement in said recesses of said support ring in the end positions of said rail support.

34. The rail loading train of claim 34 wherein said rail support has one end connected to said bearing sleeve and another free end distant to said bearing sleeve, and further comprising a stop member secured to the other end of said rail support for abutment upon a support column opposing said bearing sleeve.

35. The rail loading train of claim 34 wherein each said support column has a groove for engagement by a lower edge of said stop member.

36. The rail loading train of claim 31, further comprising a signaling system for indicating an end position of said rail supports, and a limit stop switch operatively connected to each rail support for actuation of said signaling system.

37. The rail loading train of claim 36 wherein said signaling system is an element selected from the group consisting of an optical signaling system and an acoustic signaling system.

38. The rail loading train of claim 36 wherein said signaling system is formed by a lamp assembly mounted to an upper end of said support column.

* * * * *